United States Patent [19]

Gurzan

[11] Patent Number: 4,776,488

[45] Date of Patent: Oct. 11, 1988

[54] DEVICE FOR DISPENSING FLOWABLE MATERIAL FROM A BAG

[75] Inventor: Egon Gurzan, Hamburg, Fed. Rep. of Germany

[73] Assignee: Minnesota Mining and Manufacturing Company, St. Paul, Minn.

[21] Appl. No.: 938,566

[22] Filed: Dec. 5, 1986

[30] Foreign Application Priority Data

Dec. 14, 1985 [DE] Fed. Rep. of Germany ..... 3544244

[51] Int. Cl.[4] ..... B67B 7/24

[52] U.S. Cl. ..... 222/81; 222/107

[58] Field of Search ..... 222/90, 89, 88, 80, 222/81, 570, 569, 107; 383/906

[56] References Cited

U.S. PATENT DOCUMENTS 4,076,147 2/1978 Schmit ..... 222/89
4,483,464 11/1984 Nomura ..... 222/89
4,624,393 11/1986 Lopez ..... 222/89

FOREIGN PATENT DOCUMENTS 2525000 12/1976 Fed. Rep. of Germany .

*Primary Examiner*—Joseph J. Rolla
*Assistant Examiner*—Kenneth Noland
*Attorney, Agent, or Firm*—Donald M. Sell; Terryl K. Qualey

[57] ABSTRACT

A device for dispensing flowable material through a flexible wall of a bag, comprising a sealing part provided in the bag, and a dispensing part provided outside of the bag, the dispensing part being adapted to be mated with the sealing part as it penetrates the bag wall to form a throughgoing connection sealed against the bag wall around the opening. The sealing part and the dispensing part include, outside of the areas surrounded by their bag sealing around the opening, cooperating interlocking means which upon mating of the parts engage between them and stretch the wall of the bag taut before the bag wall is cut, and which engage in an interlocking position at the end of the mating movement of the parts.

7 Claims, 2 Drawing Sheets

FIG.4
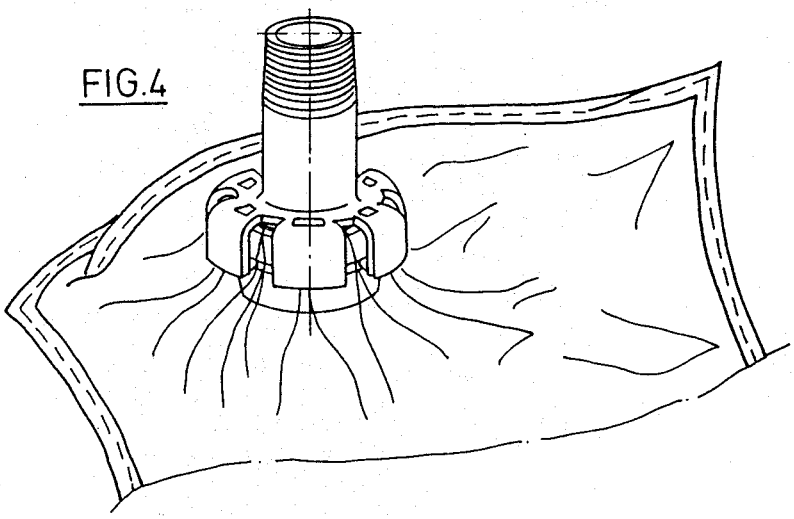
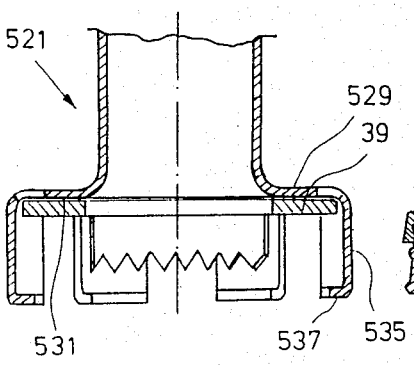
FIG.5
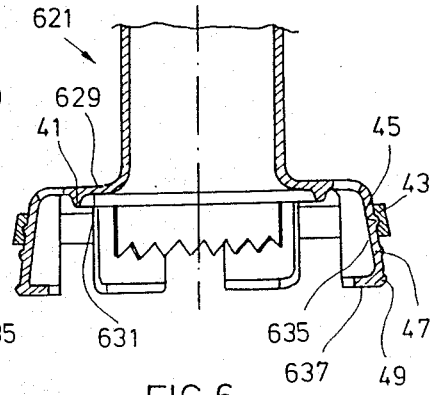
FIG.6

DEVICE FOR DISPENSING FLOWABLE MATERIAL FROM A BAG

TECHNICAL FIELD

The invention relates to a device for dispensing flowable material from a bag.

BACKGROUND ART

Frequently it is desirable to dispense a flowable material, such as filling resins from a bag without coming into contact with the atmosphere or with human skin. Also, it may be desirable to close off the dispensing device after dispensing only a portion of the contents of the bag.

West German Offenlegungsschrift No. 25 25 000 discloses a dispensing device in which an annular par is included in the bag and an exterior dispensing part mates with the annular part through the wall of the bag to dispense the flowable material. In that device the wall of the bag is cut by a central conical tip on the dispensing part which has an opening in its side wall through which the flowable material must pass. However, with that dispensing device, the conical tip may not sever but rather merely depress the bag wall into the sealing part, particularly with thick-walled or double-walled bags. Even if the bag wall is severed, an insufficient and/or non-uniform opening may result. Moreover, the throughgoing passage has an angled configuration and has a relatively small cross-section thereby limiting the types of flowable materials that can be dispensed and the flow rate from the bag.

DISCLOSURE OF INVENTION

The dispensing device of the present invention comprises an annular sealing part to be included in the bag with the flowable material, and a dispensing part to be mated with the annular sealing part from the exterior of the bag as the wall of the bag is severed to form a throughgoing connection sealed against the wall of the bag. The sealing part and the dispensing part each having an annular sealing surface that surrounds an opening through the part, which sealing surfaces may be brought into sealing engagement with the bag wall between them. The dispensing part includes cutting means in the area thereof surrounded by its sealing surface so as to cut through the wall of the bag as the sealing surfaces of the sealing part and the dispensing part are brought into sealing engagement. Cooperating resilient interlocking means are on the sealing part and the dispensing part exteriorly of the areas surrounded by their sealing surfaces, which interlocking means, upon mating of the sealing part and the dispensing part, engage between them and stretch the wall of the bag taut before the cutting means cuts the wall of the bag, and which engage in an interlocking position at the end of the mating movement.

The interlocking means will grip and stretch the bag wall taut in an early phase of the plugging step outside of the area surrounded by the sealing surfaces, whereby the cutting means can engage the bag wall more effectively, and can sever it more reliably and more uniformly. The risk is thereby avoided that areas of the bag wall will be deformed towards the interior of the bag without being severed. Towards the end of the mating process, the interlocking means will engage in their interlocking position and hold the device safely together. Since the interlocking means are arranged outside of the areas surrounded by the sealing surfaces they do not restrict the flow cross-section of the throughgoing connection.

BRIEF DESCRIPTION OF DRAWINGS

In the drawing:

FIG. 4 is an illustration like that of FIG. 1 with the sealing part and the dispensing part mated on the bag;

FIG. 5 is a partial axial sectional view of a second embodiment of the dispensing part; and FIG. 6 is a partial axial sectional view of a third embodiment of the dispensing part.

BEST MODES FOR CARRYING OUT THE INVENTION

Figure 1:
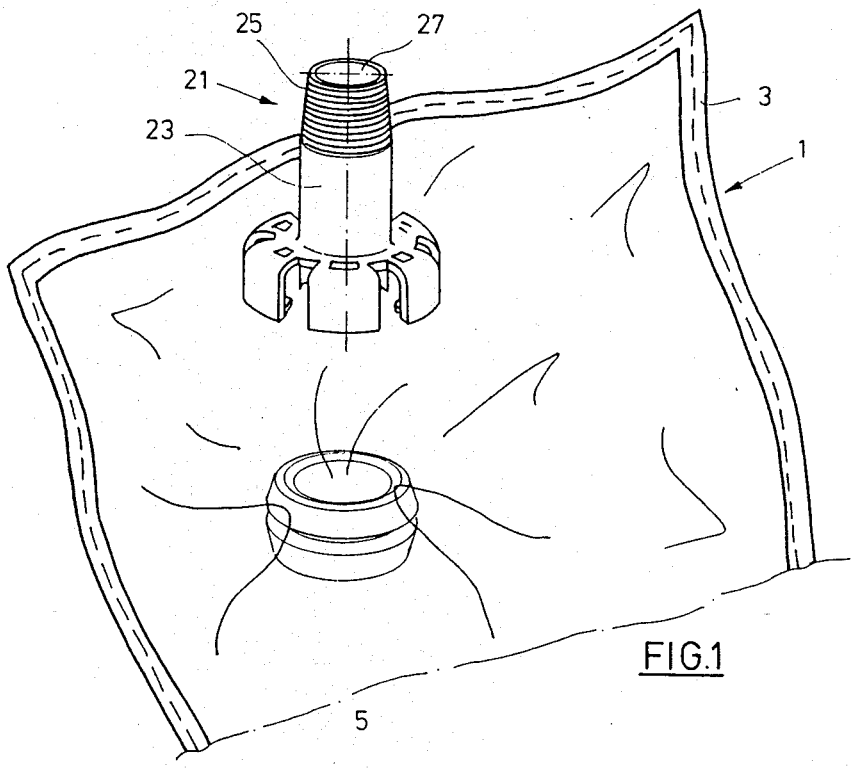
FIG. 1 is a perspective view of a device according to the invention and a bag prior to the mating of the sealing part and the dispensing part.
Figure 2:
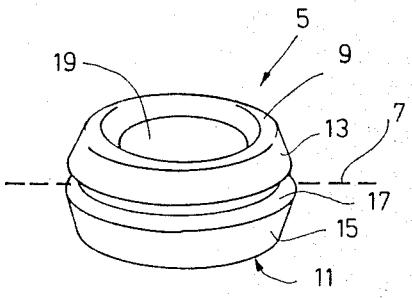
FIG. 2 is a perspective view of the sealing part of the dispensing device illustrated in FIG. 1
Figure 3:
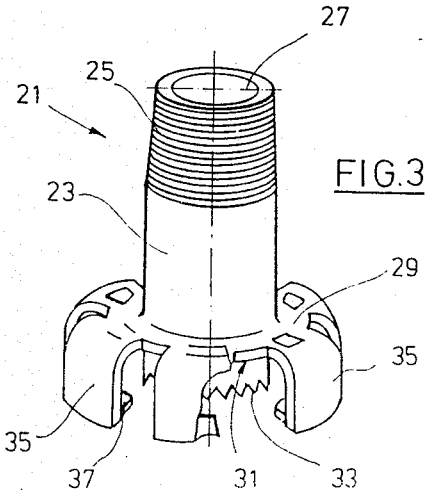
FIG. 3 is a perspective view of the dispensing part of the dispensing device illustrated in FIG. 1.

FIGS. 1 and 3 show a bag 1 which is filled with a flowable material, for instance a filling resin for use in producing a waterproof enclosure around a splice in a telephone cable. The bag is welded shut along its edge 3. In the flowable material in the interior of the bag, there is an annular sealing part 5 which is made of a material, for instance a plastic, that is compatible with the flowable material. The sealing part 5 may, if desired, be attached to the interior wall of the bag.

The sealing part 5, has a radial sealing surface 9, 11 and a conical sliding surface 13, 15, respectively, on both sides of a central plane. The sliding surfaces 13 and 15 lead to an outer annular snapping depression 17 in the central plane 7. The sealing part 5 has an axial throughgoing opening 19 bordered by the sealing surfaces 9 and 11.

Exteriorly of the bag, there is a dispensing part 21. It includes a dispensing tube 23 to which, for example, a dispensing conduit (not illustrated) may be connected by a thread 25 on the end of the dispensing tube. The dispensing tube 23 forms an axial throughgoing opening 27 and ends in a flange 29 on which an essentially annular radial sealing surface 31 is provided on the side facing away from the dispensing tube 23. The sealing surface 31 matches each of the two sealing surfaces 9, 11 of the sealing part 5. Within and close to the sealing surface 31, about ten thin-walled cutting teeth 33 are provided around the circumference of the throughgoing opening 27. In the illustrated embodiment the teeth 33 extend around 270° of the circumference of the opening. These cutting teeth 33 project axially beyond the sealing surface 31.

From the outer edge of the flange 29, resilient snapping tongues 35 depend exteriorly of the sealing surface 31 in the same direction as the cutting teeth 33. The snapping tongues 35 have interiorly depending free end areas 37. The surfaces of the end areas 37 which engage with the bag wall upon the mating of the sealing part and the dispensing part are dimensioned so, taking into account the spring force of the snapping tongues 35, that a desired frictional pressure is exerted on the bag wall. That frictional pressure is such that the wall is frictionally entrained and stretched taut, but not torn, by the snapping tongues.

During assembly a dispensing part 21 is mated with the sealing part 5 by positioning it over the sealing part and pressing it down on the area of the bag wall that covers the sealing part. Upon mating of the sealing part and the dispensing part, an area of the bag wall is initially engaged and stretched taut between the free end portions 37 of the snapping tongues 35 and the opposed sliding surface 13. The free end areas 37 of the snapping tongues 35 continue to slip on the bag wall supported by the sliding surface 13 until they snap into the annular snapping depression 17 of the sealing part 5 (with the bag wall interposed) at the end of the mating process. Thereby, a strong interlocking connection is formed between the sealing part 5 and the dispensing part 21. The dimensions are selected so that in the snapped-in condition illustrated in FIG. 4, the bag wall is clamped and sealed between the sealing surfaces 9 and 31 of the sealing part 5 and the dispensing part 21, respectively. Prior to reaching the snapped-in final position, the cutting teeth 33 cut asymmetrically into the stretched area of the bag wall and tear a hole into the bag wall so that a straight throughgoing passage for withdrawing the flowable material is created.

FIGS. 5 and 6 illustrate alternative embodiments of the dispensing part. In FIGS. 5 and 6, parts which correspond to parts in FIGS. 1 through 4 are designated with the same reference numerals as there, however, with a precedent number 5 or 6, respectively. Insofar as like reference numerals apply, reference is made to the description with respect to FIGS. 1 through 4.

FIG. 5 illustrates an embodiment of a dispensing part 521 in which an additional sealing ring is provided in the form of an annular disc 39 in the space between the interiorly projecting free end areas 537 and the sealing surface 531 of the flange 529.

FIG. 6, shown in an illustration similar to FIG. 5, is an embodiment of a dispensing part 621 in which a unitary annular sealing ridge 41 is provided on the sealing surface 631 of the flange 629. A corresponding sealing ridge can be additionally provided also in the embodiment according to FIG. 5 (not illustrated). Such a sealing ridge can be generally provided on one of two cooperating sealing surfaces to improve the sealing effect.

In the embodiment according to FIG. 6, the snapping tongues 635 are surrounded by an axially displaceable securing ring 43 provided for increasing the interconnection force between the sealing part and the dispensing part. During the mating of the parts, the securing ring 43 is held in a neutral position close to the flange 629, i.e. distant from the free end areas 637 of the snapping tongues 635, so that it does not disturb the function of the snapping tongues 635. After the mating, the securing ring 43 is moved into a securing position shifted towards the free end areas 637, in which it secures the snapping tongues 635 against outward movement and thus secures the obtained connection against disengagement. The interconnecting force can be still further improved if, as illustrated in FIG. 6, the outer diameter defined by the snapping tongues 635 increases slightly towards the free end areas 637. In FIG. 6, that slight increase is shown exaggerated for reasons of clarity. The increased interconnection force may be particularly desirable if highly viscous material is to be dispensed from a bag with the application of high pressing forces.

I claim:

1. A device for dispensing flowable material through a flexible wall of a bag, comprising:

an annular sealing part to be included in the bag with the flowable material, a dispensing part to be mated with said annular sealing part from the exterior of the bag as the wall of the bag is severed to form a throughgoing connection sealed against the wall of the bag, said sealing part and said dispensing part each having an annular sealing surface that surrounds a dispensing opening extending generally axially therethrough, which sealing surfaces may be brought into sealing engagement with the bag wall between them and said dispensing openings in registration, cutting means on the dispensing part in the area thereof surrounded by its sealing surface so as to cut through the wall of the bag as the sealing surfaces of said sealing part and said dispensing part are brought into sealing engagement, and cooperating interlocking means on said sealing part and said dispensing part, said cooperating interlocking means being radially outward of the areas surrounded by said sealing surfaces on said sealing part and said dispensing part, being formed to engage between them and stretch the wall of the bag taut as said sealing part and said dispensing part are moved toward mating engagement and before said cutting means cuts the wall of the bag, and being formed to engage in an interlocking position at the end of the mating movement of said sealing part and said dispensing part.

2. The dispensing device of claim 1, wherein the interlocking means comprise a snapping depression at the outer circumference of the sealing part and an essentially conical sliding surface leading to the snapping depression, and resilient snapping tongues on the dispensing part which mate with the snapping depression.

3. The dispensing device of claim 2, wherein the annular sealing part comprises on both sides of a central plane, a sealing surface and an essentially conical sliding surface leading to a snapping depression at the central plane.

4. The dispensing device of claim 2 wherein the snapping tongues comprise interiorly projecting free end areas designed to obtain a frictional entrainment of the bag wall to stretch the wall of the bag taut before the cutting means cuts the wall of the bag.

5. The dispensing device of claim 1, wherein the cutting means consist of a plurality of cutting teeth.

6. The dispensing device of claim 5, wherein the cutting teeth are distributed around the circumference of the opening through the dispensing part.

7. The dispensing device of claim 6, wherein there are cutting teeth around 270° of the circumference of the opening through the dispensing part.

* * * * *